US007007428B2

(12) United States Patent
Santa Cruz et al.

(10) Patent No.: US 7,007,428 B2
(45) Date of Patent: Mar. 7, 2006

(54) VERTICAL TELESCOPIC STAGE ACCESSORIES DEVICE

(76) Inventors: Cathy D. Santa Cruz, 7630 Tholl Dr., Reno, NV (US) 89506; Gordon E. Churchward, 270 Main St. #14., Silver City, NV (US) 89428

( * ) Notice: Subject to any disclaimer, the term of this patent is extended or adjusted under 35 U.S.C. 154(b) by 1007 days.

(21) Appl. No.: 09/771,457

(22) Filed: Jan. 18, 2001

(65) Prior Publication Data

US 2002/0092244 A1 Jul. 18, 2002

(51) Int. Cl.
*E04G 3/00* (2006.01)

(52) U.S. Cl. ..... 52/7; 52/8; 182/132; 182/150; 182/186.6; 472/77

(58) Field of Classification Search ..... 52/6–7, 52/28, 121; 248/158; 182/150, 132, 147–148, 182/186.6; 160/123–124, 331; 472/77, 472/75; 362/403–404
See application file for complete search history.

(56) References Cited

U.S. PATENT DOCUMENTS 2,070,334 A * 2/1937 Garber ..... 182/113
2,700,798 A * 2/1955 Perrottet ..... 52/10
3,399,887 A * 9/1968 Altier ..... 187/274
4,468,904 A * 9/1984 O'Malley ..... 254/364
4,512,117 A * 4/1985 Lange ..... 403/331
4,638,604 A * 1/1987 Rogers et al. ..... 182/152
4,857,028 A * 8/1989 Pail ..... 446/75
4,863,126 A * 9/1989 Rogers et al. ..... 248/158
4,934,113 A * 6/1990 Hall et al. ..... 182/223
5,361,565 A * 11/1994 Bayer ..... 254/292
5,365,704 A * 11/1994 Ray ..... 52/64
5,612,836 A * 3/1997 Kim et al. ..... 360/85
5,689,917 A * 11/1997 St-Germain ..... 52/7
5,725,069 A * 3/1998 Sullivan ..... 182/157
5,765,314 A * 6/1998 Giglio et al. ..... 472/75
5,890,323 A * 4/1999 Errato ..... 52/6
6,024,156 A * 2/2000 Chu ..... 160/331

FOREIGN PATENT DOCUMENTS

JP 7-42297 * 2/1995

* cited by examiner

*Primary Examiner*—Winnie Yip

(57) ABSTRACT

A device having multiple support members telescopically contained therein, with each member having a set of lights, a set of curtains and various compartments for numerous stage accessories and allows for quick change of the lights and curtains that are used for different sized stage settings.

10 Claims, 9 Drawing Sheets

VERTICAL TELESCOPIC STAGE ACCESSORIES DEVICE

FIELD OF THE INVENTION

This invention relates to devices used for quick changing of stage accessories, such as portable curtains and lights. But more particularly pertains to a combination of multiple stage lights and multiple sets of curtains, all of which are contained in an overhead or below ground vertically movable device. With the device having multiple support members telescopically contained therein, with each member supporting a set of lights and a set of curtains. This allows for quick change of the lights and curtains that are used for different sized stage settings.

BACKGROUND OF THE INVENTION

In the ordinary production of drama, comedy and the like in the theater, the action takes place on or in a number of various stage settings, each of which is set up or assembled on the stage at each performance. Heretofore, it has been the custom to construct a theater with a stage that is of a fixed size, thus not allowing the stage to be variable in size for different types of performances. It is usually necessary to disassemble and store each entire stage setting after being used and then assemble another complete setting on the stage. During such time, the curtain is generally lowered and/or the stage is darkened while the scene shifting is taking place.

Within the related prior art, namely U.S. Pat. Nos. 4,863,126, 4,934,113 and 3,399,887 different devices have been taught which are functional for their intended use but they do not address the issues resolved by the present invention.

For example, the '887 reference entitled "VERTICALLY MOVEABLE STAGE AND GUARD RAIL MEANS" includes a device which is used to change stage settings from one type to another but it does not address stage lighting or curtains as taught by the present invention.

While the '113 reference entitled "PORTABLE STAGE WITH TELESCOPIC STAGE SECTIONS" addresses a device which is used to provide a portable unit which when assembled forms interconnected multi-tiered stages.

Still further, the '126 reference entitled "THEATER CURTAIN FRAME ASSEMBLY AND STORAGE ASSEMBLY" is the closest reference the applicants could find. Wherein they provide multiple interconnected curtain support structures that are mounted on rollers and supported by end towers. The device may be rolled into position and then curtains are lowered when needed. This device is somewhat functional but it includes many parts, is complicated to install, does not include lights, and most importantly it is very time consuming, thus it cannot be used for quickly changing the lights and curtains that are used for different sized stage settings.

Therefore within the known prior art, the applicants did not find a suitable means for varying the size of the stage which is enclosed by the curtains when the curtains are in a down position. Nor did the applicants find a suitable means for providing variable lighting that may be used to illuminate only the stage area that is enclosed by the curtains when the curtains are in a down position, such as during the change of the stage setting. Nor did the applicants find a suitable device that may be used for illuminating only the area wherein the performance is to take place, as addressed and resolved within the present invention.

SUMMARY OF THE INVENTION

It is therefore a primary object of the present invention to provide in combination, multiple stage lights and multiple sets of curtains that are contained in an overhead or below ground vertically movable device, and can be used in a quick efficient manner either during, or between different theatrical performances.

Another object of the present invention is to provide a stage accessories device which can be used to vary the size of the performance area.

Yet a further object of the present invention is to provide a stage accessories device that is portable and may be used at various locations other than on a theatrical stage. Such as, the device may be used in arenas, stadiums, performing arts, on basketball courts, dance studios, hockey arenas, ice skating rinks, or even above a pool, etc.

Still a further object of the present invention is to provide a stage accessories device that can be readily activated and used by unskilled persons, and requires minimal maintenance.

Yet another object of the present invention is to provide a stage accessories device that is compact when stored.

A further object of the present invention is to provide a stage accessories device that can be either supported from the ceiling by cables which are electrically operated between an up or down position, or the device can be supported by vertical posts, or the like.

Also another object of the present invention is to provide a stage accessories device that can be produced in various sizes and shapes of engineering choice. For example, each of the platforms may be in the shape of a circle, a diamond, a rectangle, a square, a triangle, etc.

Other objects and advantages will become apparent when taken into consideration with the following specification, drawings and claims.

DETAILED DESCRIPTION OF THE DRAWINGS

Referring now in detail to the drawings wherein like characters refer to like elements throughout the various views. Within FIGS. 1–4, (arrow 10) substantially represents an overall plan for the present invention which is a vertical telescopic stage device and is used to provide adjustable lights, curtains and other accessories for stages which are used for theatrical performances, or the like.

It is to be understood the present invention is applicable for many different types of uses, such as the device may be easily removably installed at various locations of choice. For example, the device may be used within stadiums, arenas, hockey rinks, basketball courts, etc.

Figure 1:
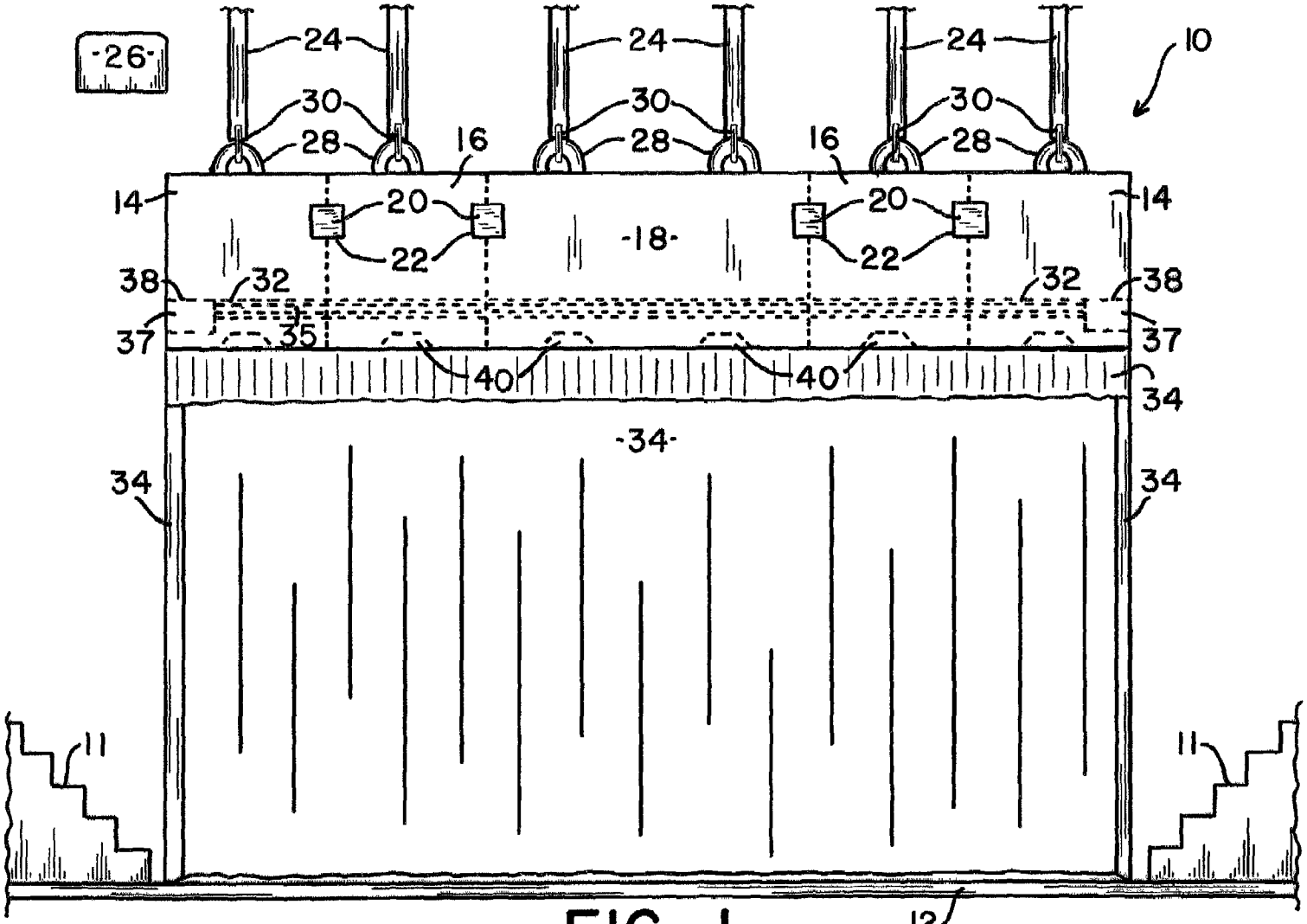
FIG. 1 is substantially a first plan view for the present invention when the device is in a first position, and shows the device being mounted overhead.

Referring now to FIG. 1, which illustrates a first embodiment for the present invention wherein (12) is a stage which can be any suitable stage or flat surface of user choice. With (11) being substantially bleachers as typically used at theatrical performances. It is to be understood that if so desired the entire stage area (12) may be surrounded with multiple bleachers (11), depending on user choice.

Vertical telescopic stage device (arrow 10) comprising a first support member (14), a second support member (16), and a third support member (18). With second support member (16) and third support member (18) each being of a shape and size to be telescopically retained within first support member (14). It is to be understood each support member (14, 16, & 18) may be made from any suitable material of engineering choice. For example, aluminum, wood, plastic, rubber, fiberglass, Plexiglas, etc. Also, each member (14, 16, & 18) may be of any shape or size of engineering choice. For example each member (14, 16, & 18) may be in the form of an oblong, a square, a rectangle, a triangle, a circle, an octagon, etc. Still further it is to be understood the device (arrow 10) is not to be limited to a specified amount of support members, as in use only two support members may be desired, or more than three, etc.

Each of the support members (14, 16, & 18) include attachment means of engineering choice for removably interconnecting each of the support members together. Such as by bolts and nuts, hinges, pins, or a combination thereof, etc. Or as illustrated in FIG. 1, members (14, 16, & 18) may be removably interconnected together by an elongated insert (20) which is slidably engaged within a cavity (22), with cavity (22) being formed between each of the members (14, 16, & 18) when the members are in alignment with each other.

When the device (arrow 10) is installed, members (14, 16, & 18) may be adjustably supported from an overhead structure, such as ceiling support beams, by suitable support means of engineering choice, such as by ropes, chains, etc. Or as illustrated within FIG. 2, suitable support means for supporting members (14, 16, & 18) includes cables (24). With the support means, the cables (24) and each of the support members (14, 16, & 18) being independently operable between various up and down positions by a typical prior art cable system which is electronically connected to a typical prior art motor (26). Again, any suitable means of controlling or adjusting the cables (24) is inherent within the invention. The support means or cables (24) are removably attached to each of the support members (14, 16, & 18) by any suitable removable attachment means of engineering choice. For example in FIG. 1, we illustrate each of the support members (14, 16, & 18) being removably supported by multiple upraised cable hold members (28), and each of the cables (24) include a hook member (30) fixedly attached thereon. With each of the hook members (30) being of a shape and size to be easily inserted into each of the multiple upraised cable hold members (28). Thus, each of the members (14, 16, & 18) are supported by ceiling beams (not shown), cables (24), upraised cable hold members (28), and hooks (30) in combination.

Each of the members (14, 16, & 18) include at least one internal interconnected compartment (32) for containment of at least one or multiple rods (35) with each of the compartments being in open communication with each other. With each of the rods (35) being used to support an elongated sheet of material (34) thereon. With the material (34) being either in the form of a curtain, a scenic backdrop, a projection screen, or the rods (35) may be used to support a combination of curtains, scenic backdrops and projection screens, depending on user choice. Also, each of the rods (35) may be independently operated by multiple prior art drive motors (37) which are housed within multiple compartments (38) located within first support member (14). It is to be noted in FIG. 1, only two drive motors (37) and two compartments (38) are shown for clarity purposes, however multiple drive motors (37) and multiple compartments (38) are included and inherent within the present invention.

Further shown in FIG. 1, members (14, 16, & 18) also include multiple prior art lights (40) or other numerous accessories of engineering or user choice. For example, members (14, 16, & 18) may include additional compartments (36) for containment of explosives, laser lights, disco lights, confetti, fireworks, a fluid such as water, flowers, balloons, smoke, fire, streamers, speakers, sound effect devices, or even a remote controlled blimp, etc. Thus, the present invention can include substantially any suitable object or device which may be used to create a spectacular show or performance.

It is to be understood the vertical telescopic stage device (arrow 10) is to be constructed in a manner which allows the device to be fully portable and can be set up or assembled at any location of choice. For example, in FIGS. 5–10 we partially show the device when disassembled.

Figure 11:
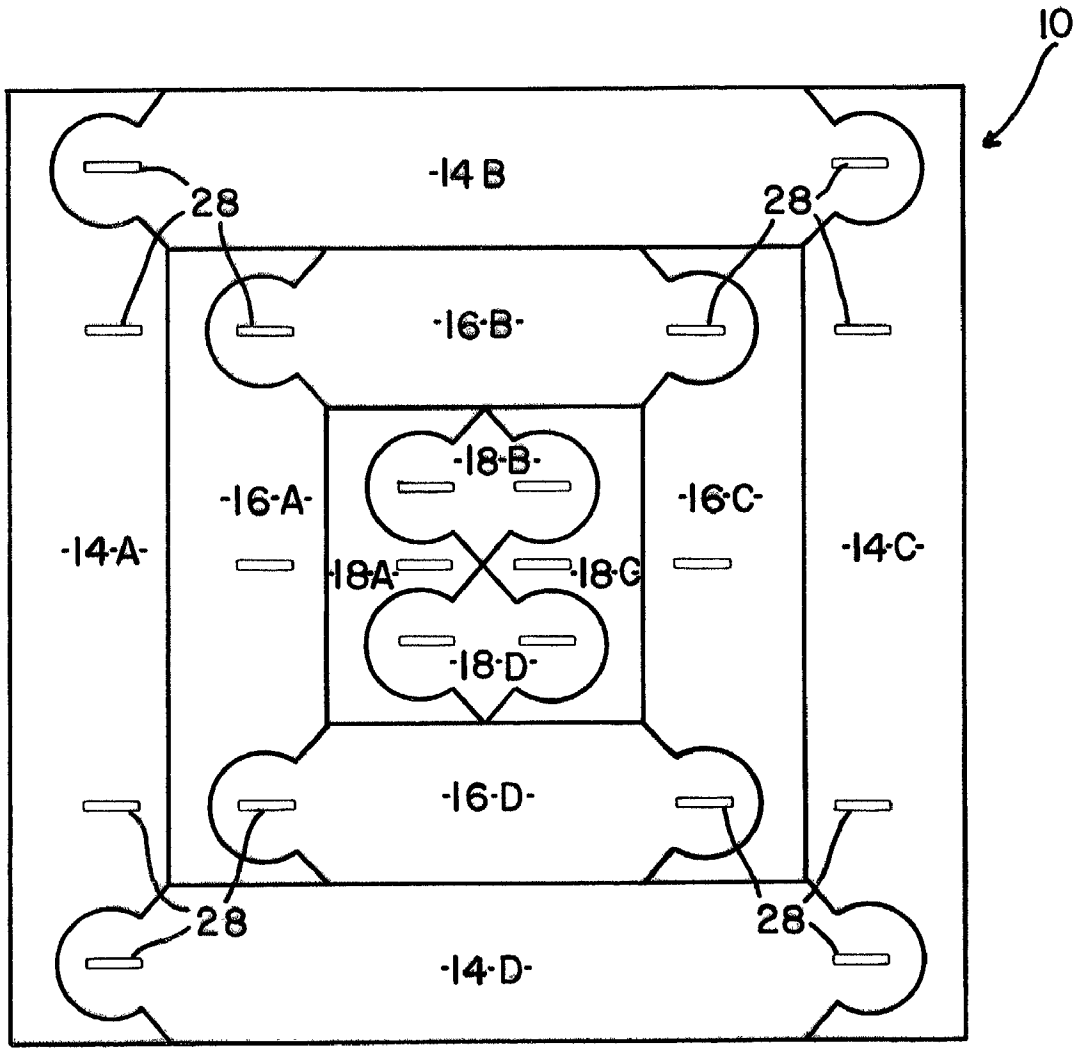
FIG. 11 substantially illustrates how each of the members may be removably interconnected together.

Referring now to FIG. 11, wherein we illustrate one manner in which the independent members (14, 16 & 18) may be removably interconnected. It is to be noted each of the members (14, 16, & 18) may be formed as one unit if desired, or as we prefer, each of the members (14, 16, & 18) include attachment means for removably interconnecting each of the members together. It is to be understood any suitable attachment means of engineering choice may be used, such as bolts and nuts, screws, etc. Or as illustrated in FIG. 11, a suitable attachment means for interconnecting each of the members (14, 16, & 18) together comprises the following.

Each of the members (14, 16, & 18) are formed from at least four interconnecting sections (14A–14D), (16A–16D), and (18A–18D). At least two of the sections which form each of the members (14, 16, & 18), include a bulb shaped protrusion (42) on their ends, such as sections (14A & 14C). While the other two sections such as (14B & 14D) include a recess (44) which is of a shape and size to slidably, frictionally receive the bulb shaped protrusion (42) therein. Whereby, each of the sections can be fit together similar to constructing a puzzle.

Referring back to FIG. 1, wherein we show how one of the rods (35) having a curtain (34) thereon, would appear when ready for transport. It is to be understood only one rod (35) and one curtain (34) is shown for clarity, but the device includes multiples of each. This is also true with the drive motors (37), cables (24), elongated inserts (20), and lights (40).

Figure 2:
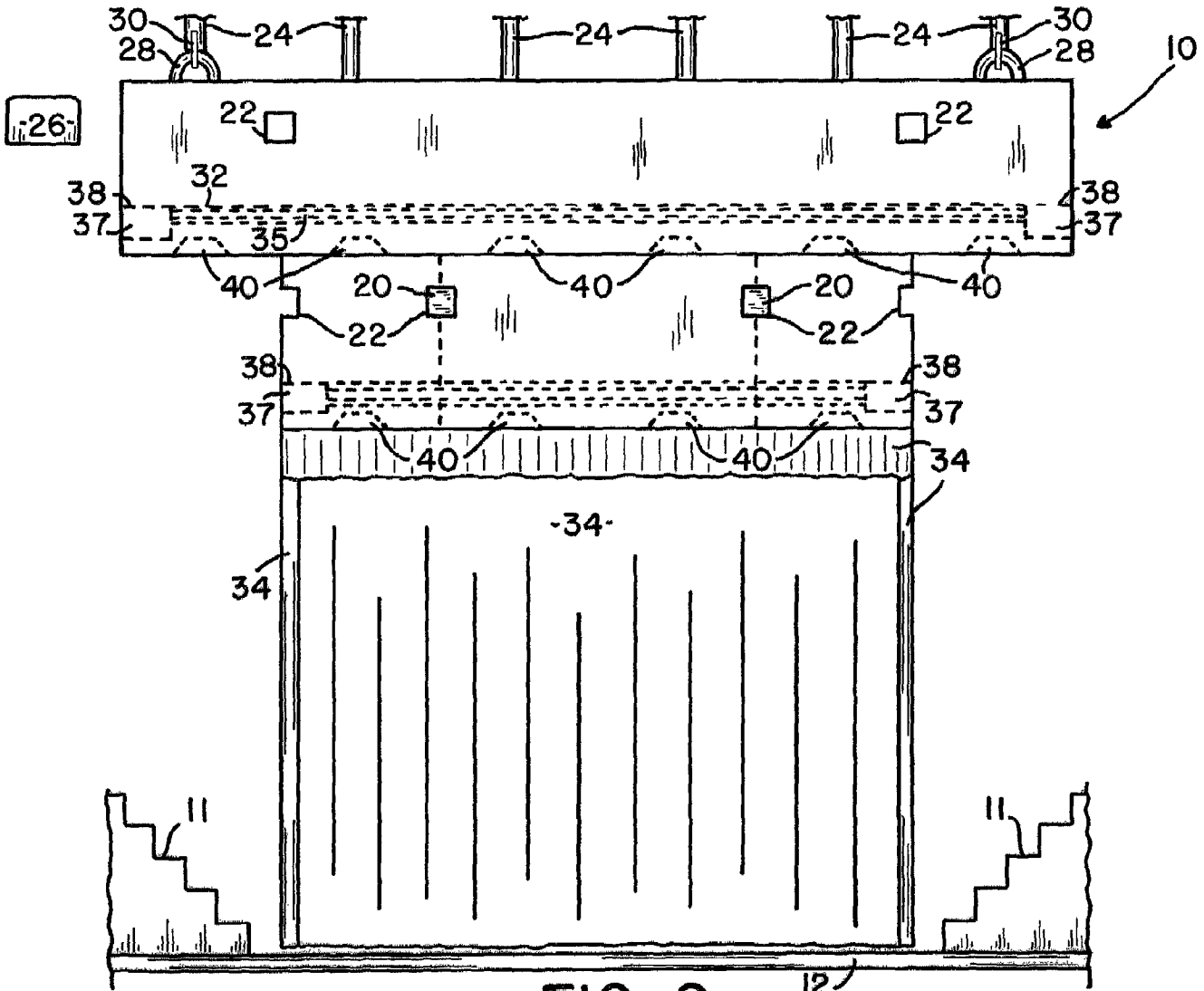
FIG. 2 is substantially a second plan view for the present invention when in a second position.
Figure 3:
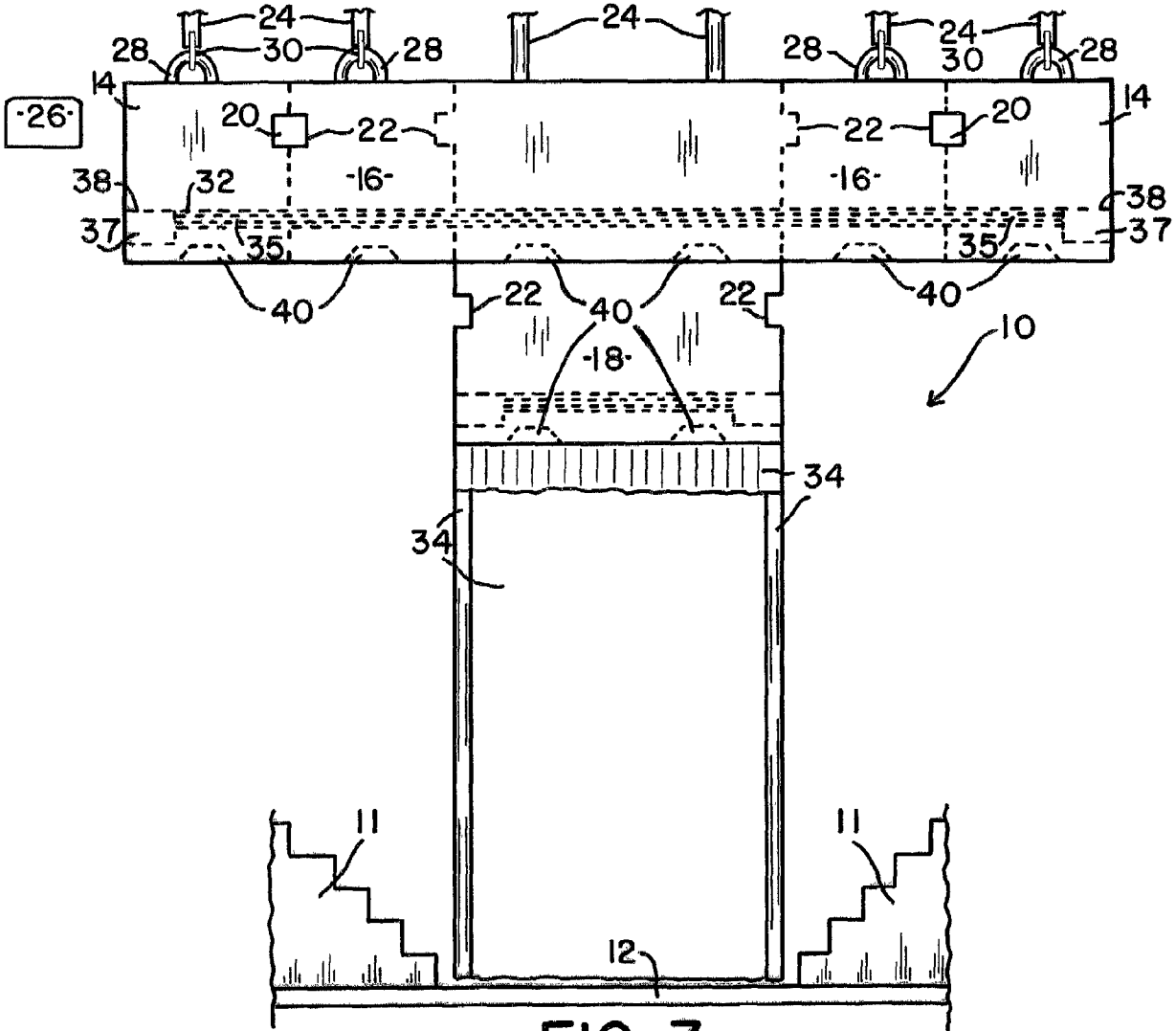
FIG. 3 is substantially a third plan view for the present invention when in a third position.
Figure 4:
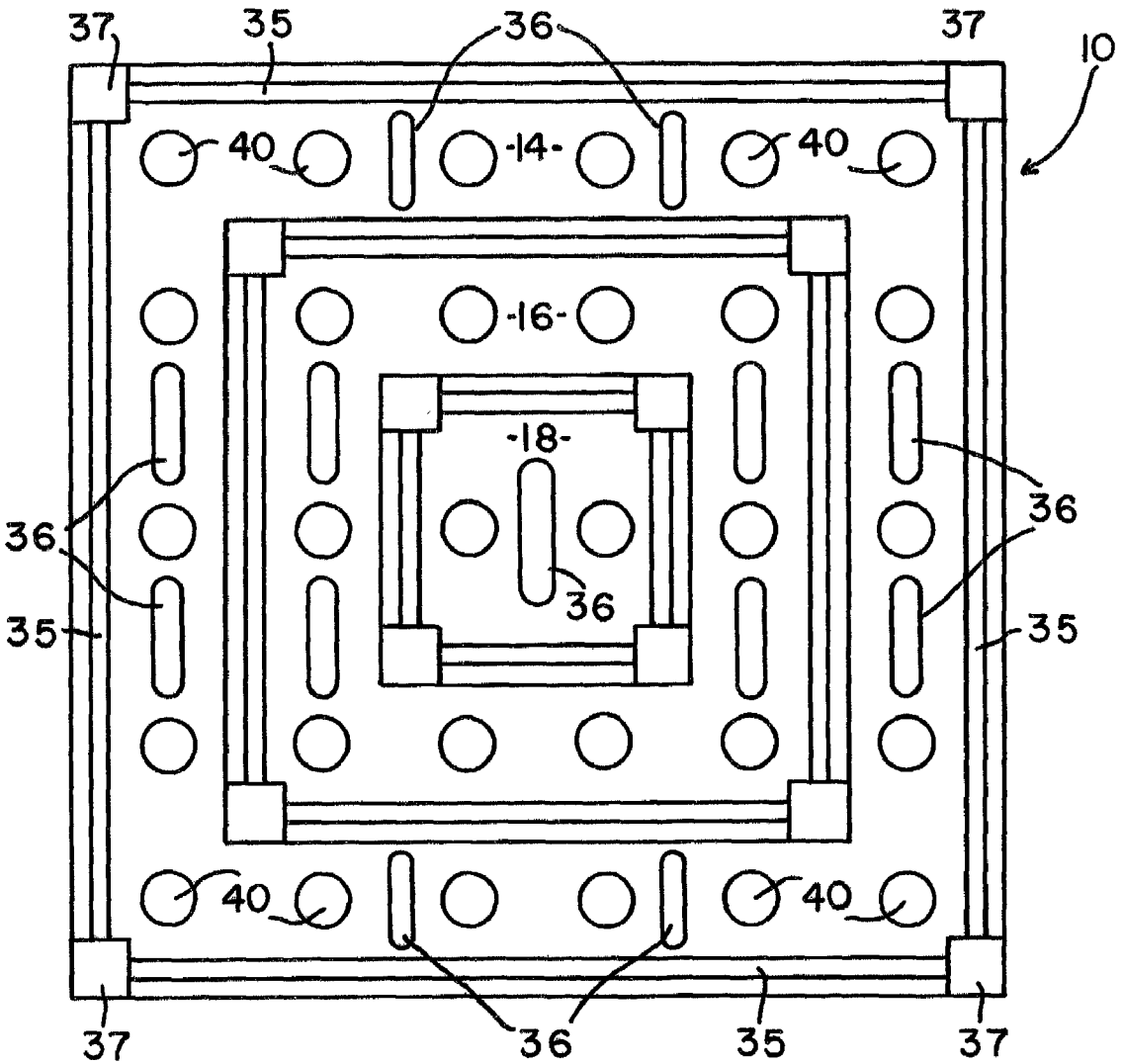
FIG. 4 is substantially a bottom view of the present invention when the device is mounted overhead.
Figure 7:
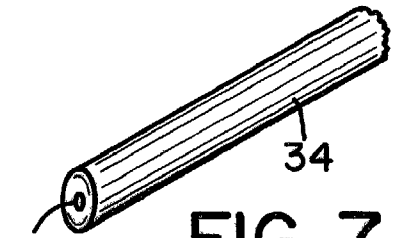
FIG. 7 substantially illustrates a curtain rod having a curtain thereon.
Figure 8:
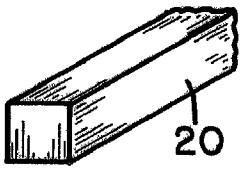
FIG. 8 substantially illustrates an elongated insert when disconnected and ready for transport.
Figure 10:
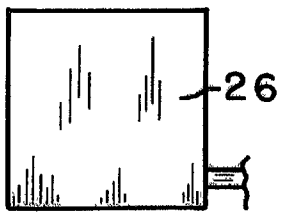
FIG. 10 substantially illustrates a portable motor.
Figure 5:
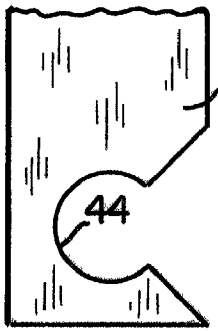
FIG. 5 substantially illustrates one of the members of the present invention when disconnected and ready for transport.
Figure 6:
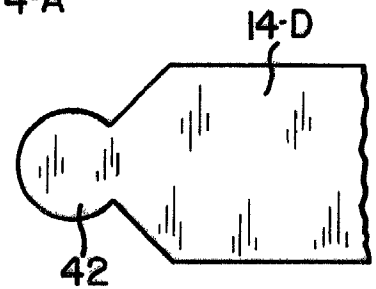
FIG. 6 substantially illustrates one of the members of the present invention when disconnected and ready for transport.
Figure 9:
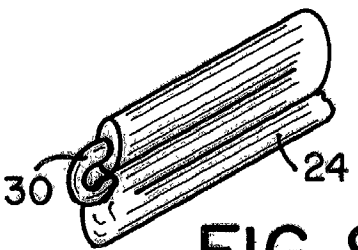
FIG. 9 substantially illustrates a cable which is disconnected, folded and ready for transport.

Throughout FIGS. 1–3 we show different positions for each of the members (14, 16, & 18). Whereby, a user can decide how large the performance area is to be. Such as in FIG. 1 the performance area is very large. Therefore all of the members (14, 16, & 18) are shown in a downward position. If the user decides a slightly smaller performance area is needed, then the first member (14) remains in an upraised position while the second and third members (16 & 18) are shown in their downward position, as illustrated in FIG. 2. Or if the user decides a very small performance area is desirable, then members (14 & 16) would remain in their upraised position while member (18) is positioned into its downward position, as illustrated in FIG. 3.

Figure 12:
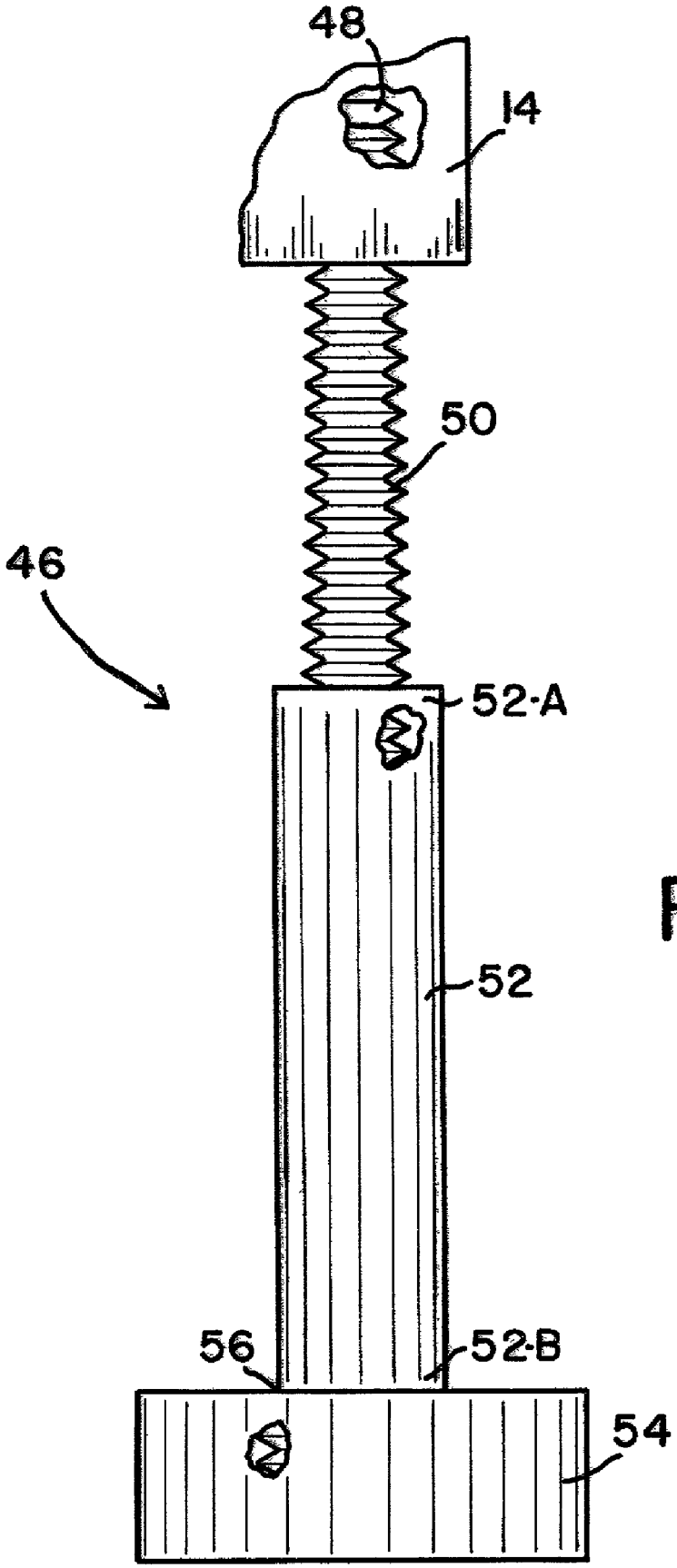
FIG. 12 substantially represents a second embodiment for the present invention.

It is to be understood that if the above described embodiment is not desirable, then the device (arrow 10) may be supported from ground level by multiple upright supports (46) as exemplified within FIG. 12. It is to be understood any suitable upright supports (46) of engineering choice may be used, such as poles, studs, steel square tubing, etc., and each of the upright supports (46) may be made from any suitable material of engineering choice, such as wood, metal, plastic, etc.

Within the last noted embodiment, it may be desirable to provide each of the members (14, 16 & 18) with an adjustable means to support and vary the height of each of the upright supports (46). Such as illustrated in FIG. 12. Wherein we depict multiple upright supports (46) comprising. Each of the members (14, 16, & 18) further include substantially an internally threaded bore (48) on four exterior corners of each of the members (14, 16, & 18) which is of a size and shape to threadably receive an externally threaded rod (50) therein. With externally threaded rod (50) being of a shape and size to threadably receive the first end (52-A) of an internally threaded rod (52) therein. Internally threaded rod having external threads on its second end (52-B). Each of the upright supports (46) further including a support foot (54) that includes an internally threaded bore (56) which is of a shape and size to threadably receive the second externally threaded end (52-B) of threaded rod (52).

It is to be understood that each of the rods (50 & 52) may be color coded for easy assembly, such as rods (50) may be color coded blue, while rods (52) may be colored red or the like.

Figure 13:
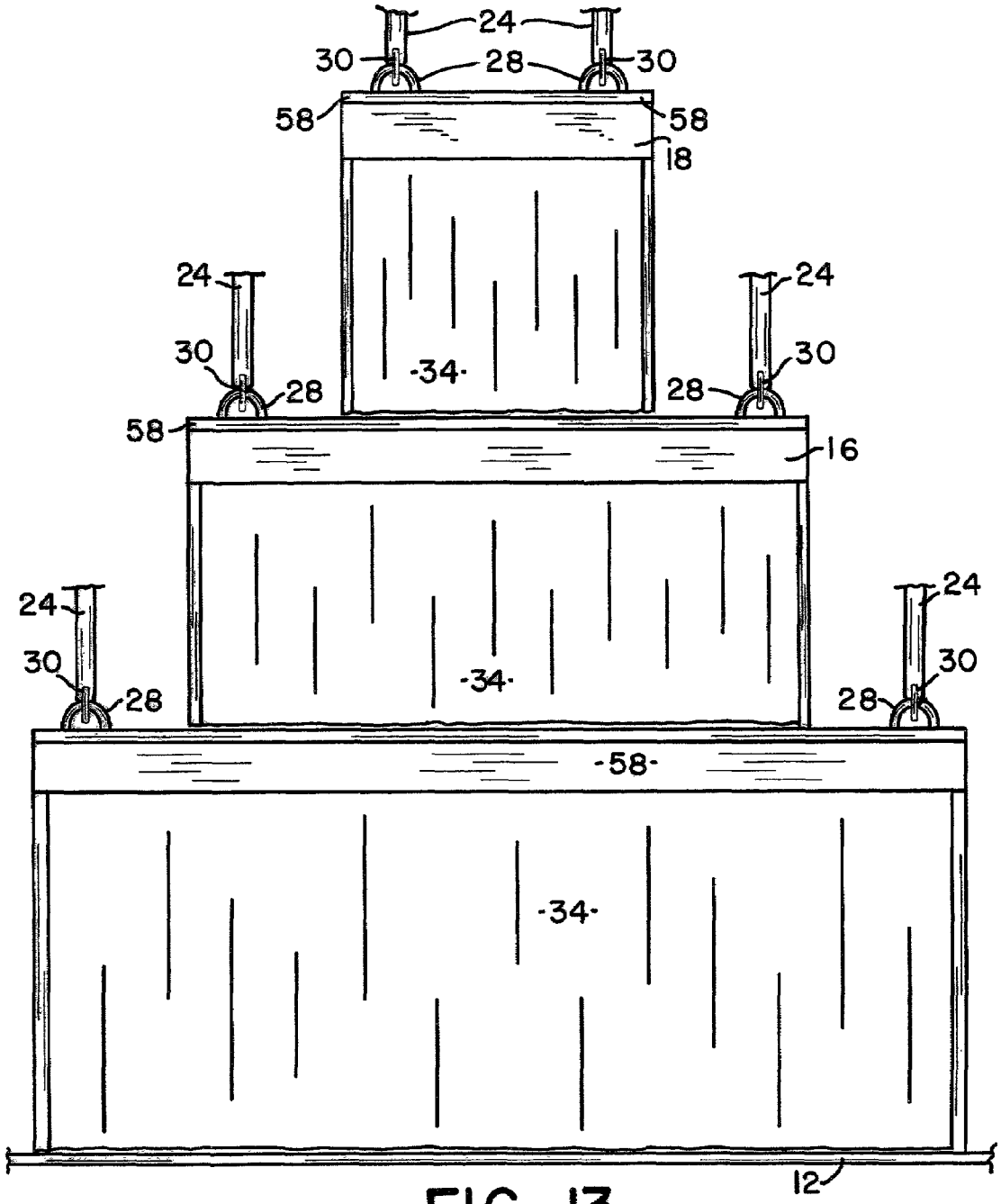
FIG. 13 substantially depicts the present device in a different configuration which allows for different performances to be simultaneously shown.
Figure 14:
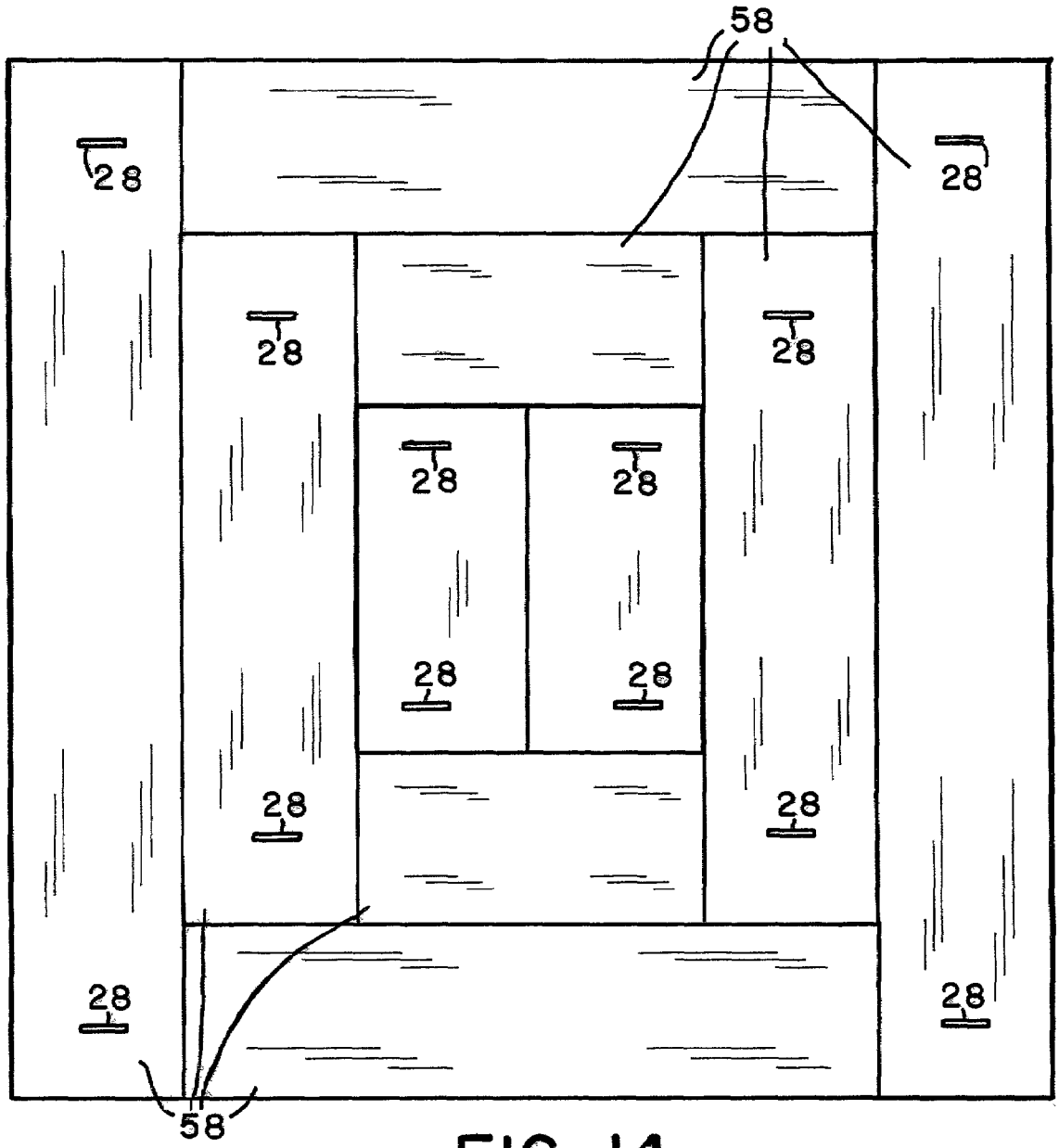
FIG. 14 is substantially a top view of FIG. 13.

Referring now to FIG. 13 wherein member (14) is shown in its downward position, with member (16) being shown in an intermediate position, and member (18) being shown in its upraised position. Also each of the members (14, 16, & 18) further include multiple floor sections (58) which are constructed in a manner to form a secure floor when each of the floor sections (58) are releasably interconnected. This is more clearly shown in FIG. 14 which is substantially a top view of FIG. 13. It is to be understood each of the noted floor sections (58) may be releasably interconnected by any suitable attachment means of engineering choice, such as by brackets, screws, butt joints, etc. Furthermore, each of the floor sections (58) include apertures which are of a shape and (size to slidably receive each of the cable hold members (28) there through.

It can now be seen when each of the members (14, 16, & 18) are positioned as described above, with each of the members (14, 16, & 18) having floor sections (58) thereon, multiple shows may be simultaneously performed. This is very advantageous and novel, as nowhere in the prior art known to the applicants do they provide interconnected stages which allow for at least three shows to be simultaneously performed in substantially a stacked manner.

It will now be seen, we have herein provided a vertical telescopic accessories stage device which is portable, includes lights, with compartments for additional accessories. The device may be suspended from overhead or be supported from ground level, is economical to produce, and most importantly allows a user to easily and quickly vary the size of the performance area.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the following claims so as to embrace any and all equivalent devices and apparatus.

What we claim as new and wish to secure by Letters Patent is:

1. A telescopic stage device in combination comprising: a first support member; a second support member; and a third support member; said second support member and said third support member each being of a shape and size to be telescopically retained within said first support member, each said support member having attachment means for removably interconnecting each said support member together, said attachment means including either bolts, nuts, hinges, pins, or a combination thereof, each said support member being adjustably supported from an overhead structure by suitable support means, said support means being removably attached to each said support member, each said support member includes at least one internal compartment for containment of at least one or multiple rods with each said compartment being in open communication with each other, said at least one or multiple rods being used to support an elongated sheet of material thereon, said at least one or multiple rods being independently operated by at least one or multiple drive motors respectively, said drive motors being housed within multiple compartments located within each said support member, and each said support member having additional compartments to contain of numerous accessories, whereby;

said support means and each said support member are independently operable between various up or down positions.

2. The telescopic stage device of claim 1 wherein said numerous accessories include either explosives, laser lights, disco lights, confetti, fireworks, a fluid, flowers, balloons, smoke, fire, streamers, speakers, sound effect devices, or a remote controlled blimp.

3. A telescopic stage device in combination comprising: a first support member; a second support member; and a third support member; said second support member and said third support member each being of a shape and size to be telescopically retained within said first support member, each said support member having attachment means for removably interconnecting each said support member together, said attachment means including an elongated insert which is slidably engaged within a cavity, said cavity being formed between each said support member when each said support member is in alignment with each other, each said support member being adjustably supported from an overhead structure by suitable support means, said support means being removably attached to each said support member, each said support member includes at least one internal compartment for containment of at least one or multiple rods with each said compartment being in open communication with each other, said at least one or multiple rods being used to support an elongated sheet of material thereon, said at least one or multiple rods being independently operated by at least one or multiple drive motors respectively, said drive motors being housed within multiple compartments located within each said support member, and each said support member having additional compartments for containment of numerous accessories, whereby;

said support means and each said support member are independently operable between various up or down positions.

4. A telescopic stage device in combination comprising: a first support member; a second support member; and a third support member; said second support member and said third support member each being of a shape and size to be telescopically retained within said first support member, each said support member having attachment means for removably interconnecting each said support member together, said attachment means including either bolts, nuts, hinges, pins, or a combination thereof, each said support member being adjustably supported from an overhead structure by a cable, said cable being removably attached to said overhead structure and each said support member, each said support member includes at least one internal compartment for containment of at least one or multiple rods with each said compartment being in open communication with each other, said at least one or multiple rods being used to support an elongated sheet of material thereon, said at least one or multiple rods being independently operated by at least one or multiple drive motors respectively, said drive motors being housed within multiple compartments located within each said support member, and each said support member having additional compartments for containment of numerous accessories, whereby;

said support means and each said support member are independently operable between various up or down positions.

5. The telescopic stage device of claim 4 wherein said elongated sheet of material is a curtain.

6. The telescopic stage device of claim 4 wherein said elongated sheet of material is a scenic backdrop.

7. The telescopic stage device of claim 4 wherein said elongated sheet of material is a projection screen.

8. The telescopic stage device of claim 4 wherein said multiple rods being used to support said elongated sheet of material thereon, said elongated sheet of material on each said multiple rods being different including in combination, a curtain, a scenic backdrop, and a projection screen.

9. A telescopic stage device in combination comprising: a first support member; a second support member; and a third support member; said second support member and said third support member each being of a shape and size to be telescopically retained within said first support member, each said support member having attachment means for removably interconnecting each said support member together, said attachment means including each said member being formed from at least four interconnecting sections, two of said sections include a bulb shaped protrusion, two of said sections include a recess, said recess is of a shape and size to slidably frictionally receive said bulb shaped protrusion therein, thus said sections can be fit together similar to constructing a puzzle, each said support member being adjustably supported from an overhead structure by suitable support means, said support means being removably attached to each said support member, each said support member includes at least one internal compartment for containment of at least one or multiple rods with each said compartment being in open communication with each other, said at least one or multiple rods being used to support an elongated sheet of material thereon, said at least one or multiple rods being independently operated by at least one or multiple drive motors respectively, said drive motors being housed within multiple compartments located within each said support member, and each said support member having additional compartments for containment of numerous accessories, whereby;

said support means and each said support member are independently operable between various up or down positions.

10. A portable telescopic stage device in combination comprising: a first support member; a second support member; and a third support member; said second support member and said third support member each being of a shape and size to be telescopically retained within said first support member, each said support member having attachment means for removably interconnecting each said support member together, each said support member being adjustably supported from ground level by multiple upright supports, said upright supports being removably attached to each said support member, each said support member being adjustably supported from an overhead structure by a cable, each said support member including multiple floor sections, said multiple floor sections form a secure floor when each said multiple floor sections are releasably interconnected, each said support member having a cable hold member, each said support member includes at least one internal compartment for containment of at least one or multiple rods with each said compartment being in open communication with each other, said at least one or multiple rods being used to support an elongated sheet of material thereon, said at least one or multiple rods being independently operated by at least one or multiple drive motors respectively, said drive motors being housed within multiple compartments located within each said support member, and each said support member having additional compartments for containment of numerous accessories, whereby;

said support means and each said support member are independently operable between various up or down positions.

* * * * *